US005259522A

United States Patent [19]

Morton

[11] Patent Number: 5,259,522

[45] Date of Patent: Nov. 9, 1993

[54] LINERLESS CLOSURE

[75] Inventor: Hugh V. Morton, Veedersburg, Ind.

[73] Assignee: H-C Industries, Inc., Crawfordsville, Ind.

[21] Appl. No.: 930,854

[22] Filed: Aug. 14, 1992

[51] Int. Cl.[5] ..... B65D 53/00

[52] U.S. Cl. ..... 215/344; 215/341; 215/343; 215/345; 215/DIG. 1; 215/252; 215/307

[58] Field of Search ..... 215/344, 341, 343, 345, 215/DIG. 1

[56] References Cited

U.S. PATENT DOCUMENTS

| | | | |
|---|---|---|---|
| 3,203,571 | 8/1965 | Plunkett | 215/344 |
| 3,255,909 | 6/1966 | Miller et al. . | |
| 3,784,041 | 1/1974 | Birch | 215/DIG. 1 X |
| 3,948,405 | 4/1976 | Yonker | 215/344 |
| 4,061,240 | 12/1977 | Brownbill | 215/270 |
| 4,090,631 | 5/1978 | Grussen . | |
| 4,196,818 | 4/1980 | Brownbill | 215/252 |
| 4,220,250 | 9/1980 | Brownbill . | |
| 4,276,989 | 7/1981 | Hicks | 215/270 |
| 4,450,973 | 5/1984 | Toeppen | 215/329 |
| 4,497,765 | 2/1985 | Wilde et al. . | |
| 4,526,284 | 7/1985 | Herbert . | |
| 4,540,102 | 9/1985 | Wiedmer | 215/344 |
| 4,549,667 | 10/1985 | Dullabaun . | |
| 4,598,835 | 7/1986 | Brownbill | 215/307 |
| 4,664,280 | 5/1987 | Whitney et al. . | |
| 5,064,084 | 11/1991 | McBride et al. . | |

OTHER PUBLICATIONS

Drawing of an H-C Industries Closure first sold in the United States in Jan., 1991, dated Sep. 21, 1990.

*Primary Examiner*—Allan N. Shoap
*Assistant Examiner*—Vanessa Caretto
*Attorney, Agent, or Firm*—Dressler, Goldsmith, Shore, Sutker & Milnamow, Ltd.

[57] ABSTRACT

A linerless plastic closure is configured for side-sealing engagement with an associated container. The closure includes a circular top wall portion, and an annular skirt portion depending from the top wall portion, and including an internal thread formation. A two-component side-seal arrangement is provided which includes a relatively rigid support annulus, and a relatively flexible sealing lip. The sealing lip is movable into a position for sealingly engaging a generally outwardly facing surface of an associated container, with the relatively rigid support annulus desirably acting to enhance the sealing effect of the sealing lip. Notably, the relatively rigid sealing annulus further desirably acts to provide a self-centering action for the closure during application to a container.

11 Claims, 1 Drawing Sheet

LINERLESS CLOSURE

TECHNICAL FIELD

The present invention relates generally to a plastic closure for use with an associated container, and more particularly to a linerless closure including a side-seal arrangement comprising a support annulus, and an integral, relatively flexible sealing lip.

BACKGROUND OF THE INVENTION

Molded plastic closures for containers have become increasingly popular for closing and sealing the contents of containers, such as for use with carbonated and non-carbonated beverages, condiments, and other food products, as well as for use on non-food products, such as motor oil. While various plastic closure constructions have been known for a number of years, special design considerations must be made in order for the desired sealing to be effected, and to facilitate high-speed manufacture and application of such closures.

In order to achieve the desired sealing performance, a number of heretofore known closure constructions have been of a composite nature, including a relatively rigid outer plastic shell, and a relatively pliable and soft inner sealing liner. One such construction, formed in accordance with commonly-assigned U.S. Pat. No. 4,343,754, U.S. Pat. No. 4,378,893, U.S. Pat. No. 4,407,422, and U.S. Pat. No. 4,497,795, all incorporated herein by reference, have proven to be highly effective for use on containers, including containers having carbonated or otherwise pressurized contents. The desired sealing performance is achieved by configuring this closure construction to include a relatively rigid and strong threaded outer closure cap, with an in situ formed liner positioned adjacent a top wall portion of the cap. Closures in accordance with these patents are configured to form a so-called top/side seal, in that the liner can sealingly engage both a generally upwardly facing surface of an associated container, as well as a generally outwardly facing, side surface of the container.

While it will be appreciated that eliminating the inner sealing liner of such closure construction would decrease the attendant cost of its manufacturing use, it has heretofore proven difficult to provide a closure construction exhibiting the requisite strength, while at the same time including a sealing arrangement exhibiting sufficient flexibility and conformability to achieve the desired sealing engagement with associated containers. Development of a linerless, one-piece closure construction suitable for use on containers having pressurized contents has heretofore met with limited success.

Another design consideration which must be addressed concerns application of closures. Experience has shown that a typical threaded closure can exhibit a tendency to skew during application, which is believed to result from the asymmetrical nature of the typical single helical thread formation within the closure. Specifically, the side of the closure at which the closure thread terminates at or near the top wall portion of the closure exhibits a relatively high degree of rigidity and strength. In contrast,. the opposite side of a single thread closure, whereat the thread is disposed one-half thread pitch further from the top wall portion, is the so-called "weak side" of the closure, exhibiting relatively less rigidity and strength (this phenomenon is not so pronounced with multi-thread closures, which tend to balance the application forces due to the symmetry of the multiple threads).

As a consequence, application of a single thread closure ca result in skewing of the closure as the "strong side" engages the associated container more securely and firmly than the "weak side" of the closure. Experience has shown that skewing of the closure which results from this effect can adversely effect the sealing performance of the closure, since its sealing element or elements may not be firmly and squarely seated on the container. This skewing can adversely affect both proper seating of a top seal as well as proper seating of a side seal.

The present closure is particularly configured for enhanced sealing performance while facilitating application to a container.

SUMMARY OF THE INVENTION

A linerless plastic closure embodying the principles of the present invention is configured to include a side-seal arrangement for sealingly engaging a generally outwardly facing side surface of an associated container. Notably, the side-seal arrangement includes two distinct portions, i.e., a relatively rigid outer support annulus, and a relatively flexible inner sealing lip extending integrally from the support annulus. By this arrangement, the relatively flexible sealing lip readily conforms to the container finish for the desired sealing engagement, with the associated support annulus supporting the flexible lip in a manner which achieves relatively high per unit area sealing force. Additionally, the relatively rigid support annulus provides a desired centering effect, during high-speed application, which facilitates application of the closure without undesirable skewing or the like.

In accordance with the illustrated embodiment, the present plastic closure includes a circular top wall portion, and an annular skirt portion depending integrally from the top wall portion. The skirt portion includes an internal thread formation configured for engagement with the associated container, with the illustrated embodiment including a single helical thread (as opposed to a double thread, triple thread, etc.).

The side-seal arrangement of the closure extends integrally inwardly from the skirt portion for sealingly engaging a generally outwardly facing surface of the associated container. As noted, the side seal arrangement includes a relatively rigid, outer support annulus which extends integrally inwardly from the skirt portion, and a relatively flexible inner sealing lip extending integrally inwardly from the support annulus. The sealing lip is movable, toward the top wall portion, to a generally upwardly extending disposition relative to the support annulus during application of the closure to a container so that the sealing lip sealingly engages the outwardly facing surface of the container.

The desired relative flexibility of the sealing lip is achieved by configuring the sealing lip to have an average axial thickness less than the average axial thickness of the support annulus. In accordance with the illustrated embodiment, the side seal arrangement includes a stepped portion which defines a distinct change in axial thickness at the juncture of the outer support annulus and the inner sealing lip. By this configuration, a hinge mechanism is provided at the stepped portion, with the sealing lip configured for relative flexibility for the desired sealing engagement with the container, while the relatively rigid support annulus exhibits the necessary rigidity to effect support of the sealing lip, and centering of the closure on a container.

In the preferred form, the support annulus is rigidified by the provision of a plurality of circumferentially spaced gussets which extend between the support annulus and the skirt portion of the closure. The rigidifying gussets are preferably configured to extend between the lower surface of the support annulus and the skirt portion of the closure, but can be alternately, or additionally, provided to extend between an upper surface of the annulus and the skirt portion of the closure.

In accordance with the illustrated embodiment, a top-seal element is provided depending from the top wall portion of the closure. This top-seal element can be provided in the form of a downwardly, outwardly diverging sealing flange, a downwardly, inwardly converging sealing flange, or other suitable top-sealing arrangement (such as a plug-type seal). The top-seal element is configured for sealing engagement with a generally upwardly facing, top surface of the associated container, and can be optionally employed in the present closure construction for enhancing the sealing characteristics of the construction.

Other features and advantages of the present invention will become readily apparent from the following detailed description, the accompanying drawings, and the appended claims.

DETAILED DESCRIPTION

Figure 1:
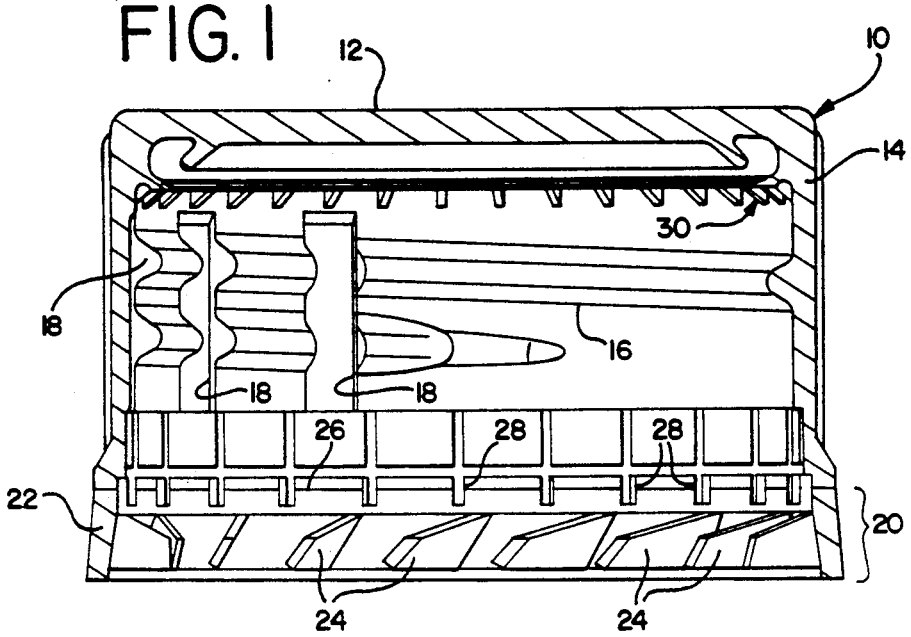
FIG. 1 is a cross-sectional view of a plastic closure embodying the principles of the present invention.

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

With reference now to the drawings, therein is illustrated a linerless, side-seal closure 10 embodying the principles of the present invention. Closure 10 can efficiently and economically be molded from plastic material, such as by compression molding of polypropylene, although other plastic materials, and molding techniques, can be employed.

Closure 10 includes a circular top wall portion 12, and an annular skirt portion 14 depending integrally from the top wall portion 12. The skirt portion 14 includes an internal, single helical thread formation 16 configured for threaded engagement with a like thread formation on an associated container (designated C in FIG. 3).

In order to facilitate use of the present closure on a container having carbonated or otherwise pressurized contents, the skirt portion of the closure defines a plurality of axially extending vent grooves 18 which facilitate venting of gas pressure from within the associated container during closure removal.

It is ordinarily desirable to configure a closure such as illustrated for tamper-evident use, and to this end, closure 10 includes an annular pilfer band 20 depending from skirt portion 14. Pilfer band 20 is illustrated as being configured in accordance with the teachings of U.S. Pat. No. 4,418,828, hereby incorporated by reference, but may alternately be otherwise configured, such as in accordance with the teachings of U.S. Pat. No. 4,938,370, or U.S. Pat. No. 5,004,112, both of which are hereby incorporated by reference.

As illustrated, pilfer band 20 includes an annular band portion 22, inwardly from which extend a plurality of circumferentially spaced, relatively flexible container-engaging projections 24. The pilfer band 20 and the skirt portion 14 are separated and distinguished from each other by a circumferentially extending scoreline 26, with the scoreline 26 extending partially into a plurality of circumferentially spaced frangible ribs 28. The unscored, residual portions of the frangible ribs 28 provide the desired frangible connection between the pilfer band and the skirt portion.

In accordance with the present invention, closure 10 includes a side-seal arrangement 30 extending integrally inwardly from skirt portion 14. Notably, side-seal arrangement 30 includes two distinct components, namely, a relatively rigid outer support annulus 32, which extends integrally inwardly from the skirt portion 14, and a relatively flexible, inner sealing lip 34, extending integrally inwardly from the support annulus 32. As illustrated, the side-seal arrangement 30 includes a stepped portion 36, at which a distinct change in axial thickness is defined at the juncture of the support annulus 32 and the sealing lip 34.

As will be appreciated, the side-seal arrangement 30 is configured such that sealing lip 34 has an average axial thickness less than the average axial thickness of the support annulus 32, with stepped portion 36 defining, in essence, a hinge mechanism for the sealing construction. While this arrangement is presently preferred, it will be understood that the side-seal arrangement may be otherwise configured. For example, the support annulus may taper into the sealing lip, and such tapering may be defined (in cross-section) by converging continuous or discontinuous straight lines, curves, compound curves, or combinations thereof. Such modifications are considered to be within the purview of the subject invention when the result is a relatively rigid support annulus effectively hingedly joined to a relatively flexible sealing lip.

As illustrated, the support annulus 32 is preferably rigidified by the provision of a plurality of circumferentially spaced rigidifying gussets 38 which extend between the lower surface of the support annulus and the inside surface of the skirt portion 14. A plurality of circumferentially spaced rigidifying gussets may be provided to extend between the upper surface of the support annulus and the skirt portion 14, such as illustrated in phantom line at 40 in FIG. 3. As will be appreciated, the preferred provision of rigidifying gussets acts to enhance the axial rigidity of the support annulus, whereby the support annulus desirably acts to support the relatively flexible sealing lip for sealing engagement with the associated container, while at the same time facilitating centering of the closure on a container during high-speed application. Additionally, the disposition of gussets 38 on the side of the support annulus which is oriented toward the open end of the closure desirably provides a guiding or "funneling" coaction of the gussets 38 with the container, thus further acting to center the closure during application.

Figure 2:
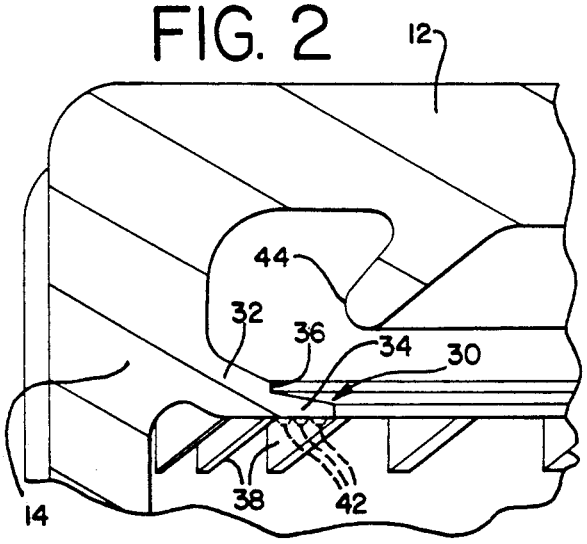
FIG. 2 is a relatively enlarged, fragmentary view illustrating the sealing construction of the present closure.
Figure 3:
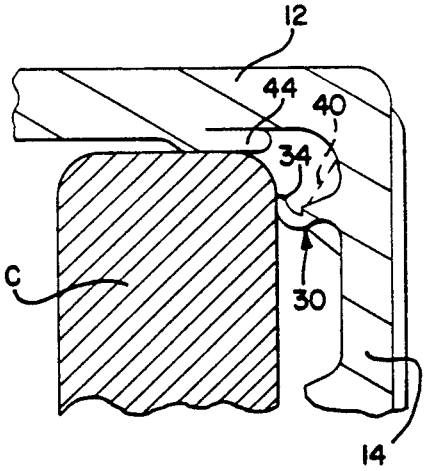
FIG. 3 is a fragmentary view illustrating the present closure in sealing engagement with an associated container.

FIG. 2 illustrates the sealing arrangement of the present closure prior to application to an associated container. In contrast, FIG. 3 illustrates the closure after application to the associated container C, wherein the sealing lip 34 has been moved to a generally upwardly extending position, relative to the support annulus, so that an inside surface of the sealing lip is presented for sealing engagement with the generally outwardly facing surface of the associated container. For some applications, it can be desirable to provide one or more sealing ribs (such as illustrated in phantom line at 42 in FIG. 2) for engagement with the container. The one or more sealing ribs extend concentrically on the sealing lip for engaging the container surface.

It is also contemplated that the sealing engagement of sealing lip 34 with the container can be enhanced by dimensioning the inside diameter of the sealing lip, prior to application to the associated container, to have an inside diameter which is slightly less than the outside diameter of the finish of the associated container. By this arrangement, an interference fit is created, resulting in stretching and elongation of the sealing lip, thereby enhancing the sealing effect created thereby.

By the provision of the relatively rigid support annulus 32, the bending and stretching of the flexible sealing lip 34 is confined to a relatively small area, thereby generating a relatively large sealing contact force, per unit area, between the sealing lip and the sidewall of the container finish. Additionally, if used on a container having pressurized contents, any internal gas pressure which may act against the side-seal arrangement 30 desirably reacts against the seal lip 34 to increase the sealing force against the container.

For some applications, such as on containers having relatively low tolerances (due to greater precision during container molding), the sealing lip 34 can be configured to substantially entirely deform upwardly during closure application. As a result, the base of the sealing lip is brought into substantial contact and alignment with the support annulus 32, whereby radial sealing forces are directed outwardly through the support annulus and surrounding skirt portion. This desirably elastically deforms this relatively high-strength portion of the closure, creating a high sealing contact force, per unit area, at the container finish, but minimizing permanent deformation of the support annulus and surrounding skirt. Such permanent deformation can result from cold flow or "creep" of the plastic material, but because the sealing forces are distributed over a large portion of the closure structure, cold flow inducing stresses are reduced.

This sealing effect, generally at the base of the sealing lip, can act in concert with the sealing created at the free edge portion of the lip by virtue of its interference fit with the container finish. This can provide two distinct sealing mechanisms for enhanced sealing integrity.

In contrast, use of the present closure on containers exhibiting relatively high manufacturing tolerances (such as glass containers) requires dimensioning the sealing lip 34, relative to the support annulus 32, to accommodate such tolerances, while avoiding excessive interference between the support annulus and the container. For these applications, deformation is intended to be substantially confined to the sealing lip, while the support annulus remains relatively undeformed.

Thus, the relatively greater hoop strength and axial rigidity of the support annulus 32 provides not only a desirable self-centering characteristic for the closure, but can further desirably act to confine the elastic deformation of the closure in large part to the flexible sealing lip 34 for high tolerance containers, thereby ensuring relatively large unit pressures at the closure/finish interface, which are necessary to obtain effective sealing performance with the relatively high durometer (i.e., relatively hard) closure material.

Figure 4:
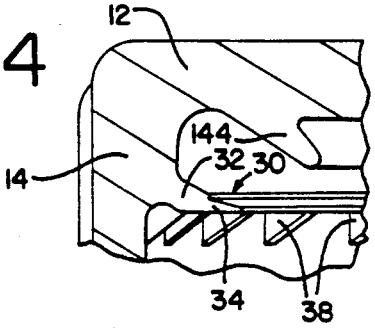
FIG. 4 is a fragmentary view similar to FIG. 2 illustrating a modified embodiment of the present closure.

As illustrated, the present closure includes a top-seal element illustrated in the form of a downwardly depending, upwardly diverging top-seal flange 44. Top-seal flange 44 is configured to sealingly engage a generally upwardly facing, top surface of the associated container C, as illustrated in FIG. 3. The optional provision of the top-seal element desirably enhances the sealing characteristics of the closure. As illustrated in FIG. 4, the top-seal element may alternately be configured as a downwardly depending, inwardly converging flange 144.

Additional benefits of the present closure construction relate to its cooperation with the container during application, and during closure removal. During application, the present closure desirably mates with and seats on a container with greater consistency, by virtue of its self-centering nature. This consistency of application, in turn, reduces variability in removal torques, thus enhancing consumer acceptance.

In connection with closure removal, experience has shown that linerless closures having a top-seal only can sometimes exhibit undesired freedom of rotation during closure removal after the top-seal element moves out of sealing engagement with the top surface of the associated container. In distinction, the side-seal arrangement provided by the present closure maintains engagement with the container for a relatively greater amount of rotation of the closure during removal, thereby desirably creating tactile-resistance to removal, and avoiding excessive freedom of rotative movement. This characteristic is believed to enhance consumer acceptance.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A linerless closure for a container, comprising:

a circular top wall portion;

an annular skirt portion, depending integrally from said top wall portion, said skirt portion including an internal thread formation configured for engagement with said container; and side-seal means extending inwardly form said skirt portion for sealingly engaging a generally outwardly facing surface of said container, said side-seal means comprising a relatively rigid outer support annulus extending integrally inwardly from said skirt portion, and a relatively flexible inner sealing lip extending inwardly from said support annulus and movable in relation to said relatively rigid support annulus toward said top wall portion for sealing engaging the outwardly facing surface of said container, said sealing lip having an average axial thickness less than the average axial thickness of said support annulus, and being distinguished from said support annulus by a change in axial thickness in said side-seal means which defines a predetermined hinge mechanism for permitting movement of said inner sealing lip relative to said outer support annulus, said side-seal means includes a stepped portion defining a change in axial thickness at the juncture of said outer support annulus and said inner sealing lip to provide said hinge mechanism.

2. A linerless closure in accordance with claim 1, including means for rigidifying said support annulus comprising a plurality of circumferentially spaced gussets extending between said support annulus and said skirt portion of said closure.

3. A linerless closure in accordance with claim 1, including top-seal means depending from said top wall portion of said closure for sealingly engaging an upwardly facing surface of said container.

4. A linerless closure in accordance with claim 1, wherein said stepped portion defines a generally vertically oriented surface.

5. A linerless closure for a container, comprising:

a circular top wall portion;

an annular skirt portion, depending integrally from said top wall portion, said skirt portion including an internal thread formation configured for engagement with said container; and side-seal means extending inwardly from said skirt portion for sealingly engaging a generally outwardly facing surface of said container, said side-seal means comprising a relatively rigid outer support annulus extending integrally inwardly from said skirt portion, and a relatively flexible inner sealing lip extending inwardly from said support annulus, said side seal means including a hinge mechanism joining said inner sealing lip and said support annulus, with said sealing lip being movable to a generally upwardly extending disposition relative to said support annulus so that said sealing lip sealingly engages the outwardly facing surface of said container, said closure including means for rigidifying said support annulus comprising a plurality of circumferentially spaced gussets extending between said support annulus and said skirt portion of said closure, said inner sealing lip further being movable relative said circumferentially spaced gussets, said side-seal means includes a stepped portion defining a change in axial thickness at the juncture of said outer support annulus and said inner sealing lip to provide said hinge mechanism.

6. A linerless closure in accordance with claim 5, wherein said gussets extend between an upper surface of said support annulus and said skirt portion.

7. A linerless closure in accordance with claim 5, wherein said gussets extend between a lower surface of said support annulus and said skirt portion.

8. A linerless closure in accordance with claim 5, wherein said sealing lip includes at least one sealing rib for sealingly engaging said container.

9. A linerless closure in accordance with claim 5, including top-seal means depending from said top wall portion of said closure for sealingly engaging an upwardly facing surface of said container.

10. A linerless closure in accordance with claim 5, wherein said sealing lip has an average axial thickness less than the average axial thickness of said support annulus.

11. A linerless closure in accordance with claim 10, wherein said stepped portion defines a generally vertically oriented surface.

* * * * *